United States Patent [19]

Townhill

[11] 3,931,969

[45] Jan. 13, 1976

[54] ADJUSTABLE GOLF CLUB

[76] Inventor: Arthur Townhill, 739 Alma Real Drive, Pacific Palisades, Calif. 90272

[22] Filed: Apr. 17, 1974

[21] Appl. No.: 461,639

[52] U.S. Cl. ..... 273/79

[51] Int. Cl.[2] ..... A63B 53/06

[58] Field of Search ..... 273/77 R, 77 A, 79, 80.1–80.8, 273/81.2, 81.3, 168

[56] References Cited

UNITED STATES PATENTS

| | | | |
|---|---|---|---|
| 1,697,846 | 1/1929 | Anderson | 273/79 X |
| 1,697,998 | 1/1929 | Novak et al. | 273/79 |
| 2,027,452 | 1/1936 | Rusing | 273/79 |
| 2,138,294 | 11/1938 | Douglas | 273/79 |
| 2,326,495 | 8/1943 | Reenstierna | 273/79 |
| 2,425,808 | 8/1947 | Jakosky | 273/79 |
| 2,644,689 | 7/1953 | Putnam | 273/79 |
| 3,477,720 | 11/1969 | Saba | 273/79 |

FOREIGN PATENTS OR APPLICATIONS

| | | | |
|---|---|---|---|
| 1,048,806 | 8/1953 | France | 273/80.1 |
| 751,323 | 6/1956 | United Kingdom | 273/79 |
| 12,200 | 5/1912 | United Kingdom | 273/79 |
| 1,232,651 | 5/1971 | United Kingdom | 273/80.1 |

*Primary Examiner*—Richard J. Apley
*Attorney, Agent, or Firm*—Hill, Gross, Simpson, Van Santen, Steadman, Chiara & Simpson

[57] ABSTRACT

An Adjustable Golf Club adapted to serve the functions of a plurality of golf clubs has a single easily manipulated locking device accommodating adjustment of the club length, loft and lie angle. The club has a blade with a ball striking face, a curved hosel extending from the heel of the blade, a shaft with a fitting slidably receiving the hosel, and a locking screw securing the hosel in a number of related positions to reproduce the lengths, lofts and lie angles of, for example, Nos. 2–10 irons. Indicia on the hosel registers with a window in the fitting to identify the iron number for each adjusted position.

6 Claims, 9 Drawing Figures

ADJUSTABLE GOLF CLUB

FIELD OF THE INVENTION

This invention relates to the art of adjustable golf clubs, and particularly golf club irons and provides a single club serving the function of an entire set of irons. Specifically the invention deals with an adjustable golf club iron which by manipulation of a single device will vary the characteristics of the club from long to short distance irons.

SUMMARY OF THE INVENTION

According to this invention there is provided an adjustable golf club which will permit a golfer, through the use of a single clamp screw, to change the loft, the length of the club, and the lie angle of the sole of the striking blade of the club to the axis of the shaft or linear direction of the shaft. These are the variables which are changed in making a choice of golf clubs when playing golf.

The golfer usually carries several iron clubs, a complete set of which are marked from 2–10. The club with the longest shaft is No. 2 and is about 6 cm. longer than the No. 10 iron. The angle of the center line of the shaft to the longitudinal sole of the blade, which is known as the lie angle of the club when the golfer addresses the ball, will be about 4° less on the No. 2 club than on the No. 10 club. The loft of the striking face of the club which is measured by the angle of the striking face with respect to the shaft or the ground, is about 15° to the shaft on the No. 2 club and about 45° on the No. 10 club. The lengths and angles of the clubs lying between the No. 2 and No. 10 clubs will be between the above mentioned ranges.

Theoretically golf clubs are designed so that the one having the less loft is used to obtain greater distance. If the angular velocity of the golfer's swing is constant, the force on the club head varies as the the square of the shaft plus arm length and the striking force will be held in that proportion. Hence the shaft is made longer for distant shots and is decreased for greater accuracy in making shorter shots while the loft angle is also increased to impart a higher trajectory and less roll to the ball.

Standard golf clubs have a tubular shaft and a head with a striking face laterally of the shaft. The shaft is about 90 cm. long with a grip at its upper end and tapering to a small diameter at its lower end. The blade of the club is about 5 cm. wide and 8 cm. long to provide sufficient surface to strke the ball. One end of the blade has a stem receiving the lower end of the shaft. This portion of the blade is known as the "hosel."

This invention provides a single golf club which through the use of an elongated curved hosel and a fitting on the small diameter end of the shaft remote from the hand grip slidably receiving the hosel enables a golfer who ordinarily would use several wood clubs, a plurality of iron clubs, and a putter to now use only the wood clubs, one adjustable iron club and a putter. The maximum number of clubs generally used is 14 but the use of this invention reduces that number to a total of six clubs.

Further with the increased popularity of so-called par 3 or short golf courses, only iron clubs and a putter are needed. This invention thus enables a golfer to play such courses with only a single adjustable iron club and a putter making a particularly convenient golf club set for use in retirement communities where the players of advanced age do not wish to be burdened with the weight of many golf clubs.

It is therefore an object of this invention to provide an adjustable golf club capable of replacing a plurality of golf club irons without sacrificing the functions of any of the irons.

Another object of this invention is to provide an adjustable golf club which will reproduce the club length, the loft angle, and the lie angle of a wide variety of golf club irons by a simple manipulation of a locking screw.

A further object of this invention is to provide an adjustable golf club iron having a shaft with a curved passage at its lower end, a blade with a hosel slidable through the curved passage and curved along its length upwardly and rearwardly from the heel of the blade in a plane less than normal to plane of the striking face of the blade so that the lie angle of the blade will vary directly with the loft angle of the blade and a sliding adjustment of the hosel in the passage will reproduce the lengths, lofts and lie angles of a plurality of individual irons.

A further object of this invention is to provide an adjustable golf club iron which is adjusted by a single device that is not immobilized by accumulation of sand or mud on the parts.

A further object of the invention is to provide a single adjustable golf club iron with a single locking device that is easily manipulated to vary the club usage throughout a wide range of long irons, mid irons and short irons.

Another specific object of the invention is to provide an adjustable golf club which is easily manufactured and does not require costly close tolerances of the parts.

A further object of the invention is to provide a golf club with a blade having an elongated curved and inclined hosel mounted through a fitting on the end of a golf club shaft which has a window registering with indicia on the hosel to indicate the club adjustment.

Other and further objects of this invention will be apparent to those skilled in this art from the following detailed description of the drawing which illustrates one embodiment of the invention.

Figure 4:
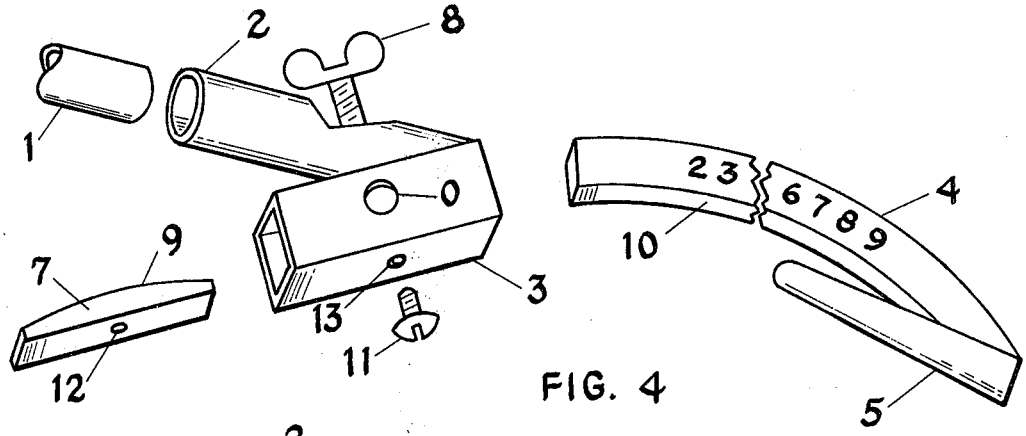
FIG. 4 is an exploded isometric view, with parts broken away, of the components of FIGS. 1–3.

The golf club of this invention, as shown in the drawings, is composed of shaft 1 with a grip on the large diameter end thereof and tapering to a small diameter end on which is mounted a fitting 2. The fitting 2 is secured to a square tube 3 with a passage slidably receiving the hosel 4 of a blade 5 which has a ball contacting or striking surface 6, a sole or ground engaging surface at the bottom of the striking face, a toe at the outer end of the striking face and a heel at the inner end of the striking face. The hosel 4 extends upwardly and rearwardly from the heel end of the blade. A spacer 7 is fitted in the bore of the square tube 3. A clamping screw 8 is threaded through the fitting to engage the hosel 4 for locking the hosel in a fixed position in the passage of the tube 3. The spacer 7 has a curved face 9 configured to mate with the concave curved face 10 of the hosel. The spacer 7 is held in the tube 3 by a screw 11 threaded into the spacer at 12 and passing through a hole 13 in the tube.

A hole or window O in the side of the tube 3 is positioned so that indicia numerals 2 thru 9 on the hosel 4 will register selectively with the window to show the club adjustment.

The cylindrical tube 2 fitted on the shaft 1 is fused to or otherwise permanently attached to the square tube 3 at an angle of about 30° so that the square tube tilts back rearwardly and the hollow interior of the square tube opens downwardly at the bottom of the tube and rearwardly at the top of the tube. The hosel 4 has its concave side 10 slidably engaging the curved side of the spacer 7 and the clamping screw 8 threaded in the fitting presses this concave side 10 of the hosel tightly against the curved face 9 of the fitting holding the hosel in locked position to the fitting.

Figure 5:
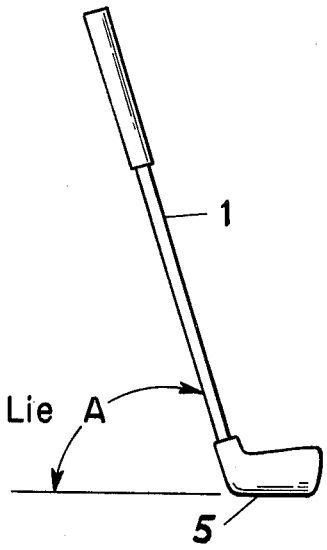
FIG. 5 is a rear elevational view of a standard golf club iron showing the lie angle of the club.
Figure 6:
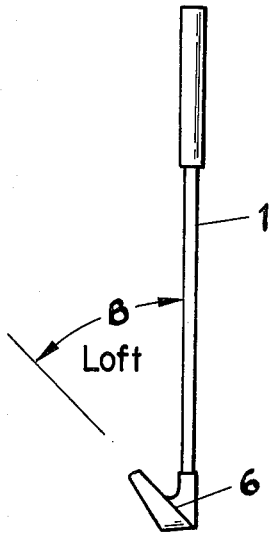
FIG. 6 is a side elevational view of the golf club iron of FIG. 5 showing the loft angle of the club.

FIGS. 5 and 6 show two of the dimensions of a golf club that change in accordance with this invention as well as on customary fixed head golf clubs. In FIG. 5 A designates the angle between the sole of the blade 5 and the rear of the shaft 1. This angle A is the "Lie" angle and decreases from the short to the long distance irons. The angle B shown in FIG. 6 between the ball contacting surface 6 of the blade 5 and the shaft B is known as the "Loft" angle and increases from the long to the short distance irons.

Figure 3:
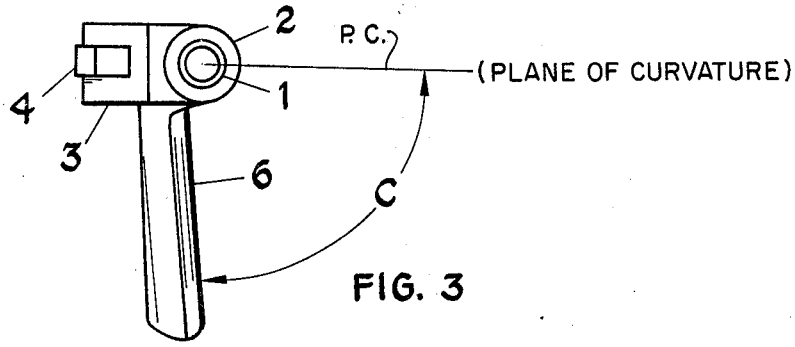
FIG. 3 is a top plan view of the club of FIGS. 1 and 2.
Figure 1:
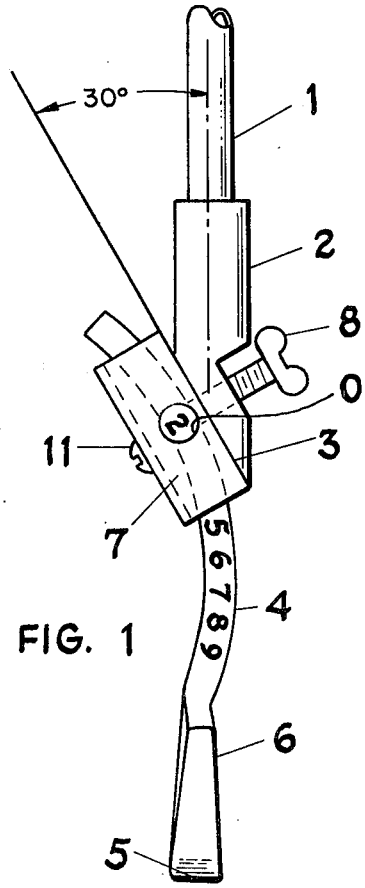
FIG. 1 is a side elevational view of the adjustable golf club of this invention with the upper end of the shaft omitted.
Figure 2:
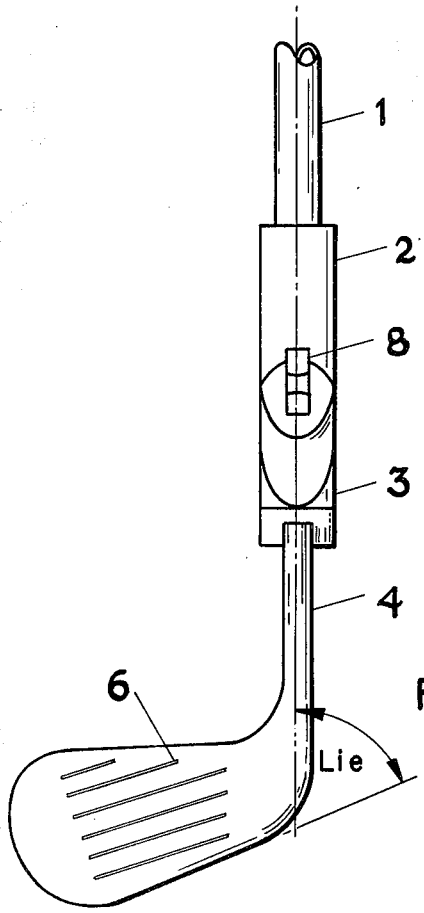
FIG. 2 is a front elevational view of the club of this invention with the upper end of the shaft omitted and showing the lie angle of the club.

The hosel 4 has a plane of curvature P.C. illustrated in FIG. 3 and the angle C between this plane of curvature and the vertical plane of the striking face 6 of the blade 5 is less than a right angle so that the Lie angle A of FIG. 5 will increase as the Loft angle B of FIG. 6 increases. Thus the hosel is inclined relative to a vertical plane which is perpendicular to the plane of the striking face 6 of the blade 5 and is curved along its length upwardly and rearwardly from the heel of the blade 5 with a radius of curvature approximately 12 cm. The angle C of FIG. 3 is preferably about 86° and the hosel plane is thus turned about 4° less than a right angle so that Lie angle A will increase (as shown in FIG. 2) as the Loft angle B increases when the hosel is moved further into the passage of the square tube 3 which is positioned laterally of the shaft 1 but coplanar with the shaft axis.

The hosel and blade unit may be made of steel or titanium and the fitting on the shaft receiving the hosel may be a single unit formed by casting or welding of steel, aluminum or titanium. The passage through the tube 3 can be curved to the same radius as the hosel or may be formed straight through the tube with the spacer 7 inserted therein having the curved upper surface 9 contacting the concave side 10 of the hosel. The spacer 7 is held within the tube by the screw 11 passing through the hole 13 in the tube and threaded into the spacer 12.

The side of the tube 3 has a hole O therethrough and a side face of the hosel 4 has numbers from 2–9 along the length thereof to selectively register with this hole O indicating the positions to which the club may be set corresponding to similar dimension fixed head clubs.

Figure 7:
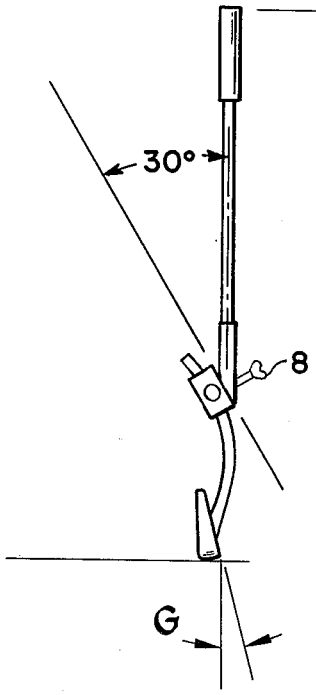
FIGS. 7, 8 and 9 are side elvational views of the club of this invention in three of its many positions of adjustment.
Figure 8:
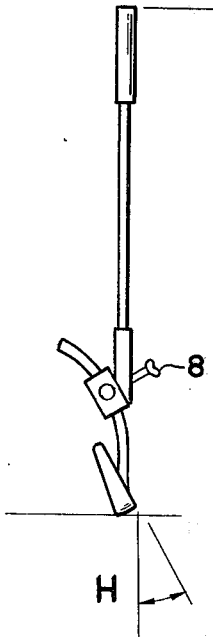
Figure 9:
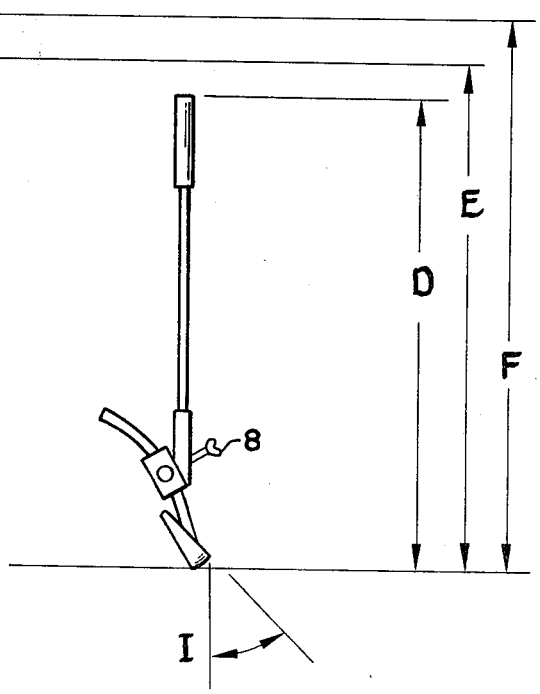

FIGS. 7, 8, and 9 diagramatically illustrate three different positions of the adjustable golf club of this invention with FIG. 7 showing the position for low loft and long distance. FIG. 8 showing the position for middle loft and middle distance and FIG. 9 showing the position for high loft and short distance. The effective length of the club varies from the long length F for the long-distance iron, the middle length E for the mid-distance iron, and the short length D for the short-distance iron. The long-distance iron will have a low loft angle G, the mid-distance iron will have a medium loft angle H, and the short-distance iron will have a high loft angle I. Since the length of the shaft from the grip to the fitting remains constant as does the combined height of the blade and hosel, the variation of the effective club length from the long-distance iron FIG. 7 to the short-distance iron of FIG. 9 is effected by sliding the fitting down on the hosel and, with the shaft remaining in the same vertical position, this not only changes the effective length of the club but also varies the loft and the Lie angles of the club to reproduce the length, Lie angle and loft of a standard club bearing the number exposed in the window of the fitting.

From the above description it will be understood that this invention provides a golf club iron of simple construction which is not difficult to manufacture and has a single adjustment positioned above the region where the club would contact the ground so that it will not become inoperative with dirt.

It will be further understood that modifications of this invention may be resorted to without departure from the spirit and scope of the invention as outlined in the appended claims and that variance in construction and substitution of construction features are intended to be within the scope of these claims unless specifically excluded from the language thereof.

I claim as my invention:

1. An adjustable golf club for simultaneously adjusting the length, loft, and lie angles of the club thereby being adapted to serve the functions of a set of successively numbered golf clubs wherein these clubs decrease in length and increase in loft and lie angles from the lowest numbered club to the highest numbered club, said adjustable golf club comprising an elongated shaft, a hand grip on one end of the shaft, a fitting on the other end of the shaft having a curved passage therethrough substantially coplanar with the shaft axis and rearwardly directed relative to the shaft, a club head having a striking face, a rear surface, a top surface, a sole surface, a toe end and a heel end, an elongated curved hosel extending from the heel end of the club head upwardly and rearwardly therefrom and defining an acute lie angle and with its curvature being in a plane of curvature inclined relative to a vertical plane perpendicular to the plane of the striking face of the club head, said hosel being slidably mounted in said curved passage of the fitting, means on the fitting for locking the hosel in fixed position in said passage, said hosel length and said curvature of the hosel being such as to simultaneously change the effective length of the club, the lie angle of the sole relative to the axis of the shaft and the loft angle of the striking face of the club head to reproduce the club lengths, lie angles, and loft angles of said set of golf clubs when said fitting is locked to the hosel in the appropriate position.

2. The adjustable golf club of claim 1 including indicia spaced along the length of the hosel and a window in said fitting registering with said indicia whereby the indicia exposed in the window will identify the setting of the adjustable club.

3. The adjustable golf club of claim 1 wherein said means on the fitting locking the hosel in fixed position in the passage is a clamp on the fitting.

4. The adjustable golf club of claim 1 wherein the hosel is the arc of a circle struck from a fixed center on a radius of 12 cm.

5. The adjustable golf club of claim 1 wherein the club is an iron and has a club head with a blade.

6. The adjustable golf club of claim 1 wherein the inclination of the plane of curvature relative to the vertical plane perpendicular to the plane of the striking face of the club head, is 86°.

* * * * *